US010290928B2

(12) United States Patent
Yoshino et al.

(10) Patent No.: US 10,290,928 B2
(45) Date of Patent: May 14, 2019

(54) ANTENNA

(71) Applicant: Sony Semiconductor Solutions Corporation, Kanagawa (JP)

(72) Inventors: Yoshitaka Yoshino, Tokyo (JP); Makoto Makishima, Saitama (JP); Satoru Tsuboi, Kanagawa (JP); Tomomichi Murakami, Tokyo (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 69 days.

(21) Appl. No.: 15/504,702

(22) PCT Filed: Jul. 3, 2015

(86) PCT No.: PCT/JP2015/003367
§ 371 (c)(1),
(2) Date: Feb. 17, 2017

(87) PCT Pub. No.: WO2016/031116
PCT Pub. Date: Mar. 3, 2016

(65) Prior Publication Data

US 2017/0271752 A1 Sep. 21, 2017

(30) Foreign Application Priority Data

Aug. 26, 2014 (JP) ..... 2014-171288

(51) Int. Cl.
*H01Q 1/24* (2006.01)
*H01Q 1/46* (2006.01)
(Continued)

(52) U.S. Cl.
CPC ..... *H01Q 1/245* (2013.01); *H01Q 1/46* (2013.01); *H01Q 1/526* (2013.01); *H01Q 7/08* (2013.01); *H01Q 9/02* (2013.01)

(58) Field of Classification Search
CPC ..... H01Q 1/46
(Continued)

(56) References Cited

U.S. PATENT DOCUMENTS 8,270,919 B2 9/2012 Yoshino et al.
2015/0055020 A1 2/2015 Yoshino et al.
2015/0200464 A1* 7/2015 Yoshino ..... H01Q 1/46 343/841

FOREIGN PATENT DOCUMENTS

JP 2007-243993 A 9/2007
JP 2010-226508 A 10/2010
(Continued)

OTHER PUBLICATIONS

Written Opinion and English translation thereof dated Sep. 29, 2015 in connection with International Application No. PCT/JP2015/003367.

(Continued)

*Primary Examiner* — Graham P Smith
(74) *Attorney, Agent, or Firm* — Wolf, Greenfield & Sacks, P.C.

(57) ABSTRACT

An antenna includes: a connection device for connection with an electronic device; a cable connected to the connection device; and a high-frequency cutoff unit that is formed of a material having high impedance in a high frequency and disposed at a given position of the cable. The cable with a length defined by the high-frequency cutoff unit functions as an antenna.

10 Claims, 13 Drawing Sheets

(51) Int. Cl.
*H01Q 1/52* (2006.01)
*H01Q 7/08* (2006.01)
*H01Q 9/02* (2006.01)

(58) Field of Classification Search
USPC ..... 343/702
See application file for complete search history.

(56) References Cited

FOREIGN PATENT DOCUMENTS

| | | | |
|---|---|---|---|
| JP | 2011-172122 | A | 9/2011 |
| WO | WO 2007/138670 | A1 | 12/2007 |
| WO | WO 2013/125347 | A1 | 8/2013 |
| WO | WO 2014/010481 | A1 | 1/2014 |

OTHER PUBLICATIONS

International Preliminary Report on Patentability and English translation thereof dated Mar. 9, 2017 in connection with International Application No. PCT/JP2015/003367.

* cited by examiner

100

A

B

| | Horizontal polarization | | | | | | | |
|---|---|---|---|---|---|---|---|---|
| Freq[MHz] | 470 | 520 | 570 | 620 | 670 | 720 | 770 | 906 |
| Peak[dBd] | -8.72 | -7.57 | -6.66 | -5.78 | -3.24 | -0.54 | -3.50 | -2.57 |

A

B

| | Horizontal polarization | | | | | | | |
|---|---|---|---|---|---|---|---|---|
| Freq[MHz] | 470 | 520 | 570 | 620 | 670 | 720 | 770 | 906 |
| Peak[dBd] | -9.19 | -6.66 | -7.36 | -5.78 | -3.39 | -1.36 | -4.10 | -2.17 |

A

B

| | Horizontal polarization | | | | | | | |
|---|---|---|---|---|---|---|---|---|
| Freq[MHz] | 470 | 520 | 570 | 620 | 670 | 720 | 770 | 906 |
| Peak[dBd] | -7.92 | -9.26 | -7.56 | -7.58 | -5.04 | -1.96 | -5.30 | -3.37 |

ANTENNA

CROSS-REFERENCE TO RELATED APPLICATIONS

This application is a National Stage of international Application No. PCT/JP2015/003367, filed in the Japanese Patent Office as a Receiving office on Jul. 3, 2015, which claims priority to Japanese Patent Application Number 2014-171288, filed in the Japanese Patent Office on Aug. 26, 2014, each of which is hereby incorporated by reference in its entirety.

TECHNICAL FIELD

The present disclosure relates to an antenna applied as an antenna for a portable device such as a smartphone, for example.

BACKGROUND ART

Recently, the smartphone has been globalized, and there has been a tendency to unify the functions. However, the television broadcast reception function is different between the region where a television broadcast is viewed such as Japan and South America and the region where a television broadcast is not viewed such as Europe and America. In order to unify the design of a smartphone regardless of regions, more manufacturers have adopted not a housing type rod antenna but an antenna cable used together with an earphone in viewing a television broadcast. For example, Patent Literature 1 discloses such an antenna.

In the antenna described in Patent Literature 1, a shield line of the coaxial wire functions as an antenna element. There are formed, as an inner conductor in the core part of the coaxial line, two lines for transmitting right and left audio signals, and a ground line. A radio wave absorbing part is provided between the shield line and the inner conductor to improve the antenna characteristics.

CITATION LIST

Patent Literature

Patent Literature 1: WO 2014/010481

DISCLOSURE OF INVENTION

Technical Problem

However, the antenna characteristics are changed significantly when an earphone is fitted on a human body for use and depending on the length of the inserted earphone, which has been a problem in stability. That is, there have been problems that the reception state is changed easily by the influence of the inserted earphone and that the antenna gain is reduced by the influence of the human body. Furthermore, the radio wave absorbing part is synthetic resin in which a magnetic material, e.g., ferrite powder is mixed. In the case of such resin, an increase in the percentage of ferrite causes a problem of reducing flexibility as a cable. Thus, the increase in percentage of ferrite has had a limit. Therefore, the radio wave absorbing properties cannot be obtained sufficiently, which may have caused insufficient performance in reducing the influence of the earphone and the influence of the human body.

Therefore, the present invention aims at providing an antenna desirable in the effect of reducing the influence of an inserted earphone and the influence of a human body.

Solution to Problem

The present disclosure is an antenna including: a connection device for connection with an electronic device; a cable connected to the connection device; and a high-frequency cutoff unit that is formed of a material having high impedance in a high frequency and disposed at a given position of the cable. The cable with a length defined by the high-frequency cutoff unit functions as an antenna.

Advantageous Effects of Invention

According to at least one embodiment, the influence of an earphone and the influence of a human body are cut off by a high impedance unit. Therefore, it is possible to prevent the characteristics change due to the earphone and the gain reduction by the influence of the human body. Note that the contents of the present disclosure are not interpreted restrictively by the effects exemplified in the following description.

MODE(S) FOR CARRYING OUT THE INVENTION

Hereinafter, embodiments of the present disclosure will be described with reference to the appended drawings. The description will be given in the following order.

<1. First Embodiment>
<2. Second Embodiment>
<3. Third Embodiment>
<4. Fourth Embodiment>
<5. Modification>

Meanwhile, although the embodiments hereinafter described are preferred specific examples of the present disclosure with technically preferred various limitations, the scope of the present disclosure is not limited to the embodiments unless it is especially described to limit this disclosure in the following description.

<1. First Embodiment>

"Reception system"

Figure 1:
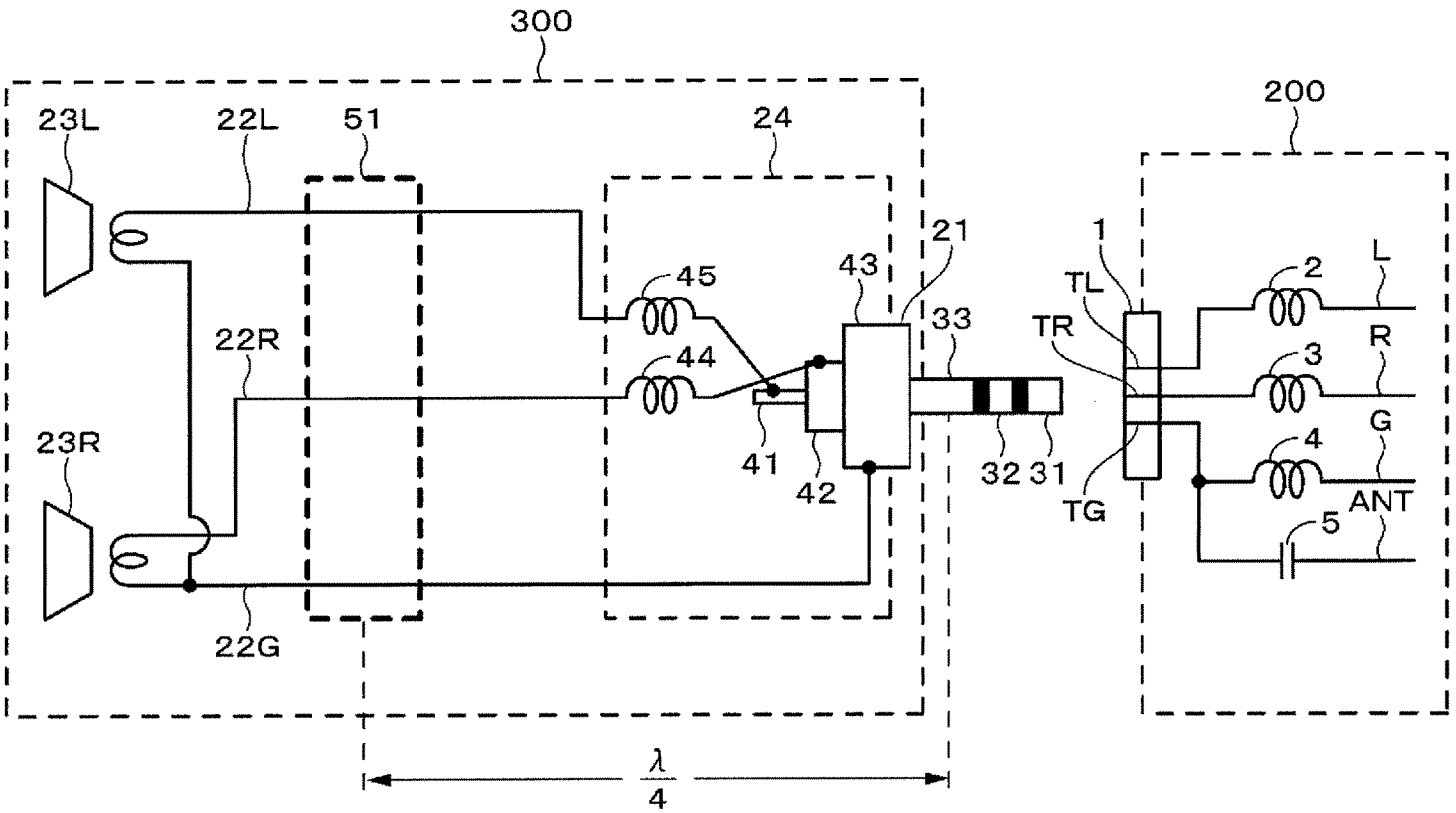
FIG. 1 is a connection diagram illustrating a reception system including an antenna according to a first embodiment of the present disclosure.

FIG. 1 illustrates an example of a connection configuration of a reception system including an antenna according to the first embodiment of the present disclosure and a portable device that is an example of an electronic device. A reception system 100 includes, as main components, a portable device 200 as an electronic device and a cable unit 300 functioning as an antenna.

The portable device 200 is a smartphone with an embedded television tuner, for example. The portable device 200 includes a display circuit, a display unit such as a liquid crystal display device, and an operation unit for performing key input and the like. The portable device 200 has a round-shaped three-pole jack 1 for earphone connection. The three-pole jack 1 and a three-pole plug 21 have a diameter of 3.5 mm, as an example.

The three-pole jack 1 formed in the portable device 200 has an electrode TL connected to a tip 31 (L channel terminal) of the three-pole plug 21, an electrode TR connected to a ring 32 (R channel terminal) of the three-pole plug 21, and an electrode TG connected to a sleeve 33 (ground terminal) of the three-pole plug 21.

A signal line of an audio L channel is drawn to the electrode TL through a ferrite bead 2. A signal line of an audio R channel is drawn to the electrode TR through a ferrite bead 3. The electrode TG is drawn as an audio ground line through a ferrite bead 4, and is drawn as an antenna signal line through a condenser 5. The antenna signal line is connected to a reception device in the portable device 200 (e.g., television tuner), although it is not illustrated. The ferrite beads 2, 3, 4 are connected to cut off a high-frequency component. Coils may be used instead of the ferrite beads.

In the first embodiment, the antenna including the cable unit 300 can receive radio wave signals of a UHF band used for receiving a digital television broadcast, for example.

The cable unit 300 includes three earphone cables 22L, 22R, 22G (simply referred to as the earphone cable 22 when these three cables do not need to be particularly distinguished from one another). Earphones 23L, 23R are connected to the earphone cable 22. The earphone cable 22G is a ground line common to the right left channels. The antenna is formed using the earphone cable 22G.

The earphone cable 22 is connected to the three-pole plug 21 through a relay 24. In the three-pole plug 21, an end portion of a rod-shaped electrode (hereinafter, appropriately referred to as the tip) 31 is exposed, and a plurality of cylindrical electrodes are sequentially exposed in the order from the end side of the tip 31. That is, the ring 32 and the sleeve 33 are provided in this order from the end side (exposure part of the tip 31). There is provided an insulating part (collar) for insulation between these electrodes.

On the back side of the three-pole plug 21, there project, in a bamboo shoot shape, an electrode 41, an electrode 42, and an electrode 43 that are connected electrically to the tip 31, the ring 32, and the sleeve 33. The earphone cable 22 is connected to these electrode 41, electrode 42, and electrode 43. Although the earphone cable 22 may be connected directly, the relay 24 is interposed to improve the uniformity of antenna characteristics.

The relay 24 is formed as a substrate or by molding. In the relay 24, the earphone cable 22R is connected to the electrode 42 on the back end part of the three-pole plug 21 through a ferrite bead 44 having a high-frequency cutoff function. The earphone cable 22L is connected to the electrode 41 on the back end part of the three-pole plug 21 through a ferrite bead 45 having a high-frequency cutoff function. Furthermore, the earphone cable 22G is connected to the electrode 43 on the back end part of the three-pole plug 21. Coils may be connected instead of the ferrite beads 44, 45. The ferrite beads 44, 45 are high-frequency cutoff elements that have low impedance in an audio band and high impedance in a high-frequency region, e.g., a VHF band or higher. Moreover, the ferrite beads 2, 3, 4 having a high-frequency cutoff function are inserted in the reception device of the portable device 200. Thus, the embodiment can also be achieved without ferrite beads having a high-frequency cutoff function in the relay 24.

A high-frequency cutoff unit (hereinafter, referred to as the high impedance unit) 51 is provided at a position of the earphone cable 22 having an antenna length of about $\lambda/4$ from a position of the sleeve 33 of the three-pole plug 21. However, in order to receive a plurality of frequencies, the main is adjusted to be in accordance with a longer wavelength, while the lower can be received by high-frequency excitation. For example, in order to receive a frequency of 200 MHz, with 32.5 cm that is ¼ of a wavelength k, the following resonance appears at 600 MHz as the triple frequency. Thus, frequencies in the vicinity can also be received. In the VHF band of a television, a wavelength $\lambda$, is 1.5 m (200 MHz) to 3 m (100 MHz). In the UHF band, a wavelength $\lambda$ is 41 cm (700 MHz) to 60 cm (500 MHz). As an example, $\lambda/4$=15 cm (500 MHz) is set.

"Example of High Impedance Unit"

Figure 2:
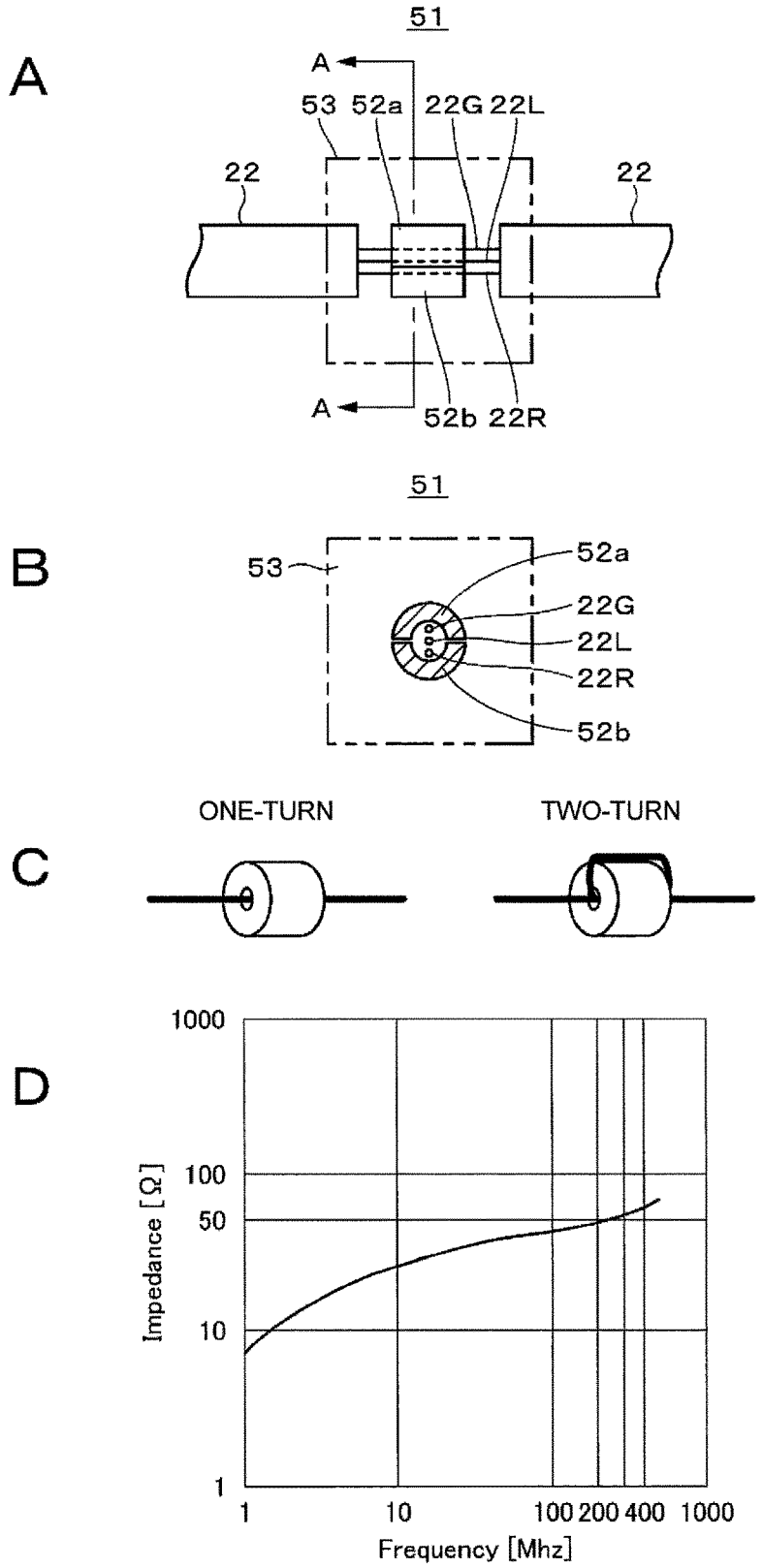
FIG. 2 is a schematic diagrammatic view used for explanation of a high-frequency cutoff unit in the first embodiment of the present disclosure.

An example of the high impedance part 51 will be described with reference to FIG. 2. As illustrated in FIG. 2A and FIG. 2B, the coating of a wire rod is removed at the above-described given position of the earphone cable 22 so that the earphone cable 22 is exposed, as illustrated in FIG. 2A and FIG. 2B. Ferrite cores 52*a*, 52*b* formed of half cylindrical ferrite sintered bodies are combined so that the earphone cable 22 penetrates through a center hole of the cylindrical ferrite core. Then, the earphone cable 22 penetrating through the cylindrical body formed of the ferrite cores 52*a*, 52*b* is fixed by a resin mold (illustrated by a two dotted chain line).

In such a high impedance part 51, a conductor penetrates through the center hole of the cylindrical (ring-shaped) ferrite core, whereby a coil is formed. Therefore, the high impedance part 51 has higher impedance at a higher frequency. Furthermore, a flow of a current in the coil formed of the ferrite core exerts the effect of losing energy due to magnetic loss occurred in the ferrite core, thus increasing impedance (resistive component).

The impedance characteristics when the ferrite cores 52*a*, 52*b* are used are determined depending on a material of the ferrite cores 52*a*, 52*b*, the size (length, diameter, center hole diameter) of the cylindrical body formed by the ferrite cores 52*a*, 52*b*, the number of turns, and the like. As illustrated in FIG. 2C, the structure in which a conductor penetrates through the center hole of the cylindrical body formed of the ferrite cores 52*a*, 52*b* is referred to as the one-turn, and the structure in which a conductor is wound once around the cylindrical body is referred to as the two-turn. As the number of turns is increased, the impedance becomes higher. Furthermore, with the use of a plurality of cylindrical bodies formed of the ferrite cores 52*a*, 52*b*, the impedance can be made higher.

FIG. 2D illustrates an example of frequency characteristics of the impedance of a single cylindrical ferrite core that can be used as the high impedance part 51. In the characteristics of FIG. 2D, the impedance is 50 (Ω) at 200 (MHz), 60 (Ω) at 400 (MHz), and 70 (Ω) at 500 (MHz).

The following impedance is actually exhibited.

200 (MHz)=50(Ω)×2 pieces×4 times (two-turn)=400(Ω)
400 (MHz)=60(Ω)×2 pieces×4 times (two-turn)=480(Ω)
500 (MHz)=70(Ω)×2 pieces×4 times (two-turn)=560(Ω)

The high impedance part 51 has a low impedance value for an audio signal band. Therefore, the high impedance part 51 does not have influence on transmission of audio signals. By contrast, the high impedance part 51 has large impedance for a high frequency signal component, as described above. Therefore, the influence of the earphones 23L, 23R and the influence of the human body are cut off by the high impedance part 51. In this manner, it is possible to prevent the characteristics change due to the earphone inserted to the antenna of the cable unit 300 and the gain reduction by influence of the human body.

<2. Second Embodiment>

"Reception System"

Figure 3:
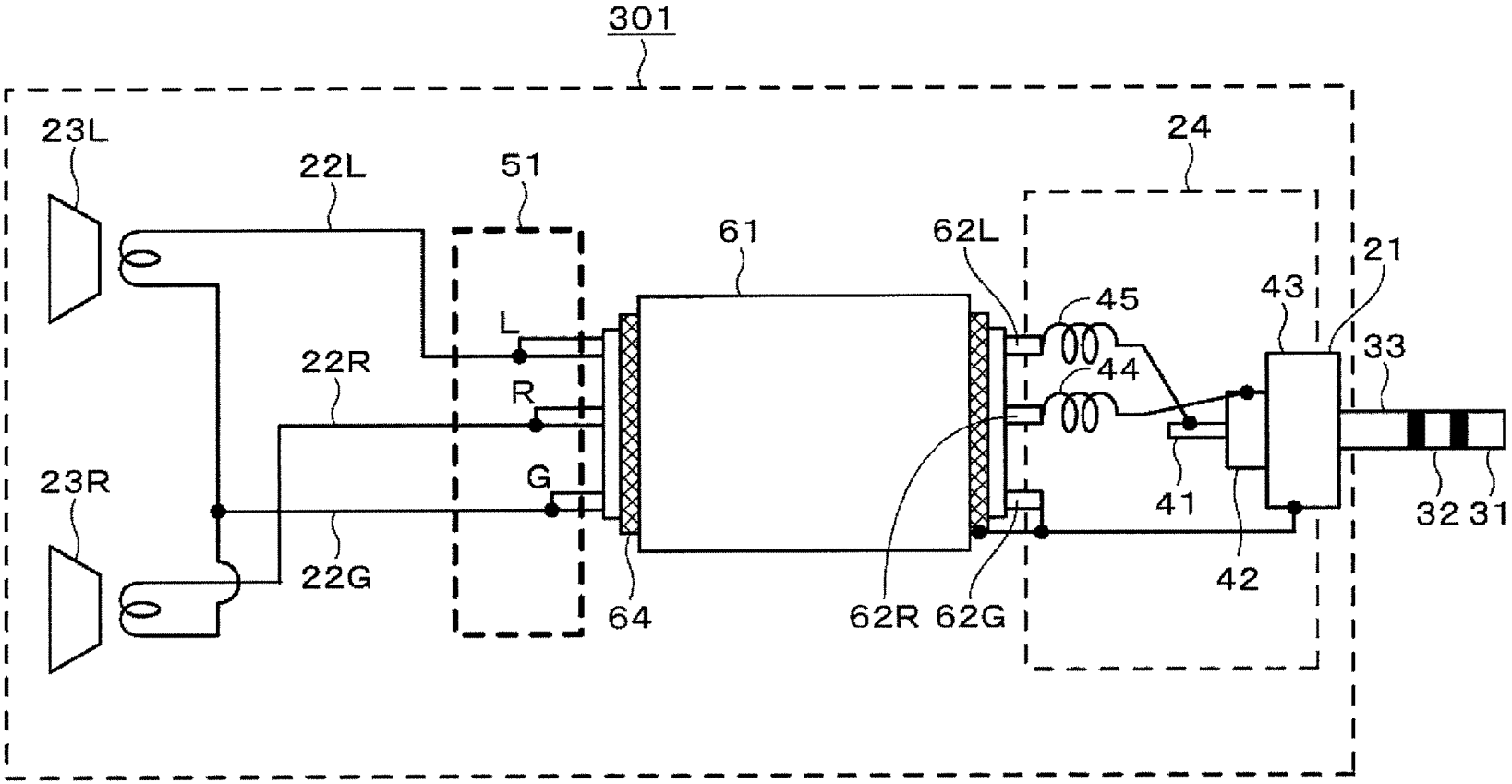
FIG. 3 is a connection diagram of a second embodiment of the present disclosure.

FIG. 3 is an example of an antenna according to the second embodiment of the present disclosure. In FIG. 3, a cable unit 301 is illustrated. The portable device is same as the first embodiment, and thus the illustration thereof is omitted.

In the second embodiment, the cable unit 301 includes a shield cable 61 connected to the three-pole plug 21, the earphone cable 22 connected between the shield cable 61 and the earphones 23L, 23R, and the high impedance part 51 inserted between the shield cable 61 and the earphone cable 22. The length of the shield cable 61 is a given antenna length, e.g., 15 cm (500 MHz).

Figure 4:
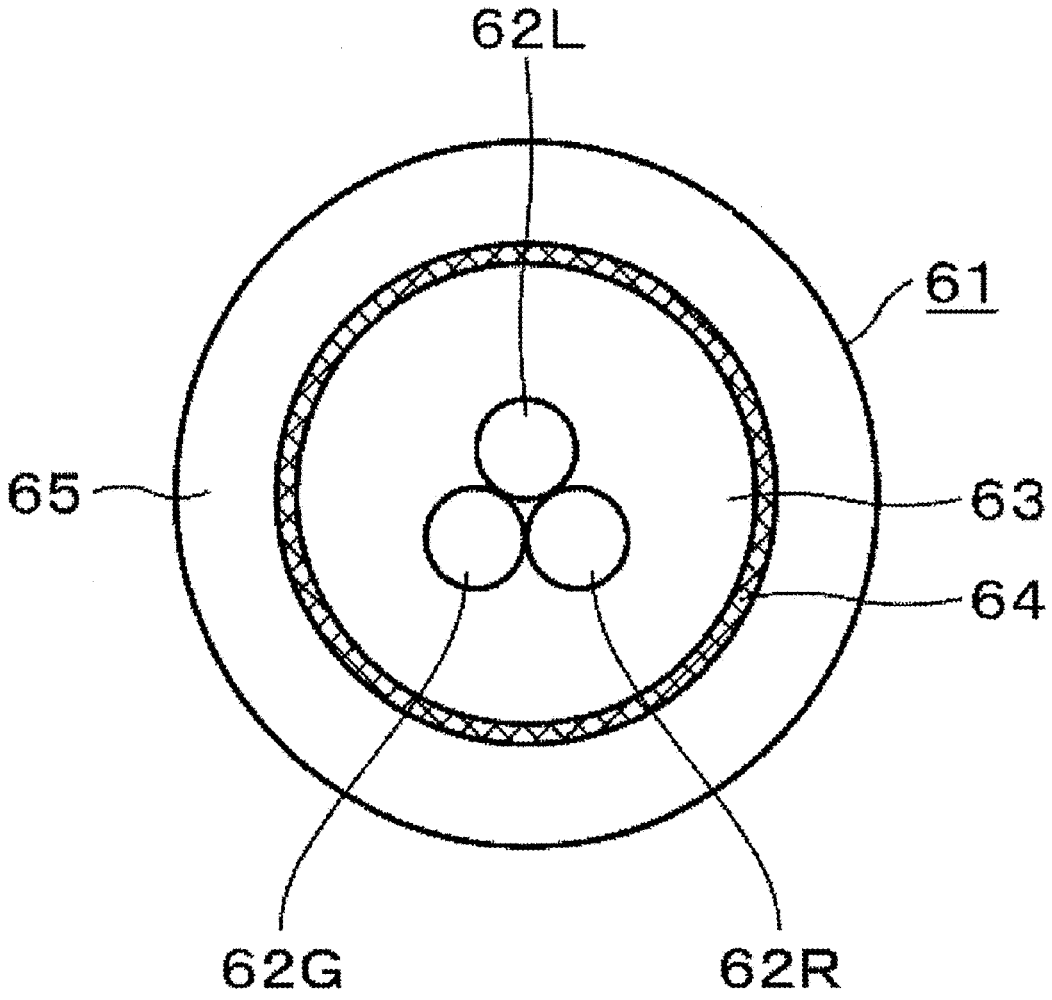
FIG. 4 is a section view used for explanation of a shield cable in the second embodiment of the present disclosure.

FIG. 4 is a section view of the shield cable 61 cut vertically in a line length direction. In the core part of the shield cable 61, there are provided, as core wire (inner conductors), a line 62L for audio signal transmission of an L channel, a line 62R for audio signal transmission of an R channel, and a ground line 62G. On the outer side of these transmission lines 62L, 62R, 62G (simply referred to as the line 62 when it is not necessary to particularly distinguish these three lines from one another), a layer of resin 63 is provided.

On the periphery of the resin 63, a shield line 64 as an outer conductor is provided. The shield line 64 functions as an antenna. The outer periphery of the shield line 64 is coated by a protective film 65. The normal resin may be used as the resin 63. However, it is preferable to use synthetic resin in which a magnetic material, e.g., ferrite powder is mixed, for example. With the use of such resin 63, the resin 63 is interposed as a radio wave absorbing part between the shield line 64 and the line 62, which secures isolation between the shield line 64 and the line 62. Thus, the characteristics of the shield line 64 as an antenna can be more desirable. Furthermore, a metal layer of aluminum or the like may be provided to secure isolation.

The lines of the shield cable 61 are connected to the electrode 41, the electrode 42, and the electrode 43 projecting on the back side of the three-pole plug 21 through the relay 24. The relay 24 is formed as a substrate or by molding. In the relay 24, the line 62R is connected to the electrode 42 on the back end part of the three-pole plug 21 through the ferrite bead 44 having a high-frequency cutoff function. The line 62L is connected to the electrode 41 on the back end part of the three-pole plug 21 through the ferrite bead 45 having a high-frequency cutoff function. Furthermore, the ground line 62G and a shield line 64 are connected to the electrode 43 on the back end part of the three-pole plug 21. Coils may be connected instead of the ferrite beads 44, 45. The ferrite beads 44, 45 are provided for high-frequency cutoff to have low impedance in an audio band and high impedance in a high-frequency region, e.g., a VHF band or higher.

The earphone cable 22R is connected to the line 62R, the earphone cable 22L is connected to the line 62L, and the earphone cable 22G is connected to the ground line 62G. At a connection position between the shield cable 61 and the earphone cable 22, the high impedance part 51 is provided.

The same high impedance part 51 described with reference to FIG. 2 can be used. With the high impedance part 51, the influence of the earphones 23L, 23R and the influence of the human body are cut off by the high impedance part 51. In this manner, regarding the antenna of the cable unit 301, it is possible to prevent the characteristics change due to the earphones and the gain reduction by influence of the human body.

<3. Third Embodiment>

"Reception System"

Figure 5:
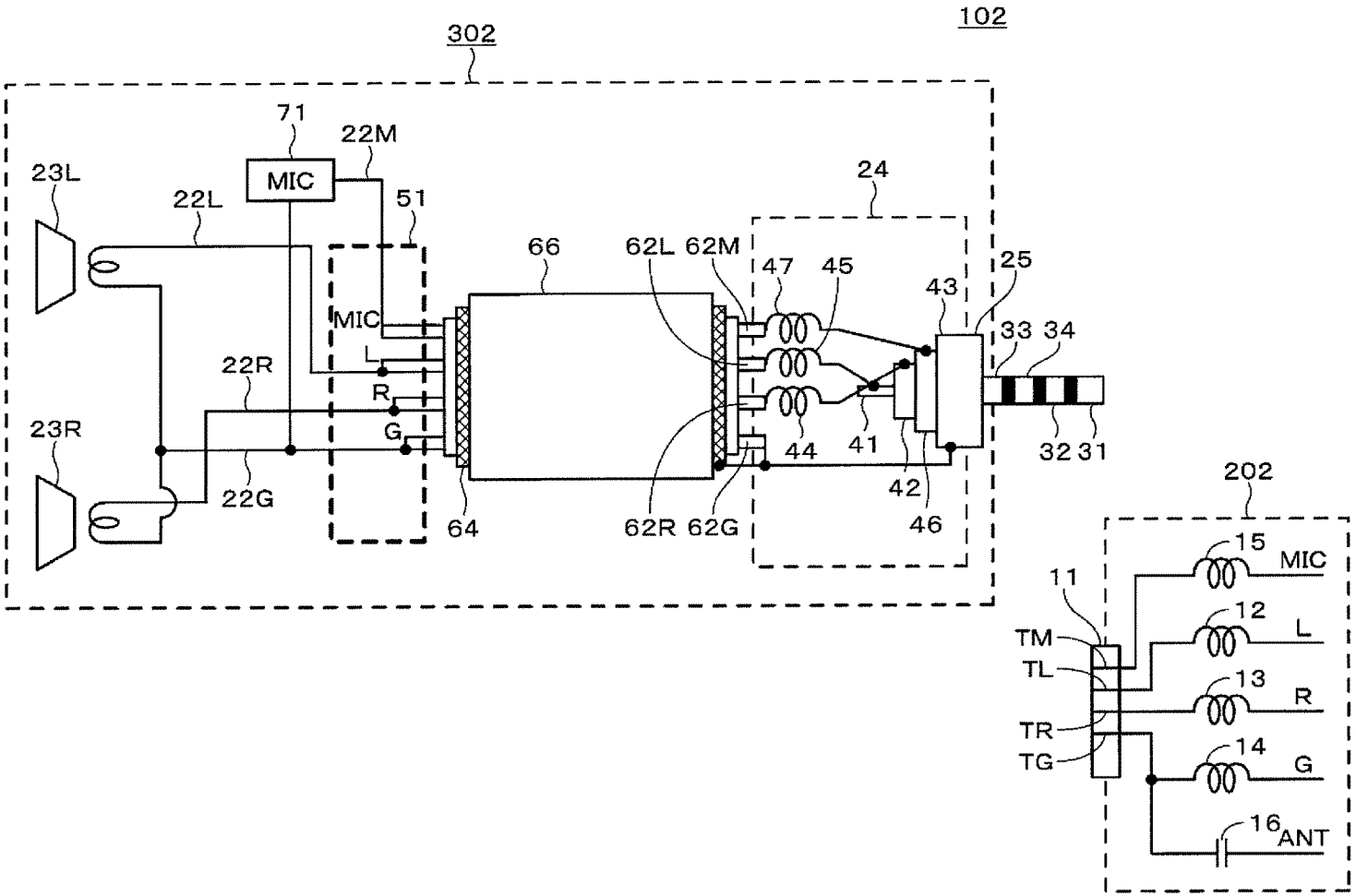
FIG. 5 is a connection diagram of a third embodiment of the present disclosure.

FIG. 5 illustrates an example of a connection configuration of a reception system (reception device) including an antenna according to the third embodiment of the present disclosure and a portable device. A reception system 102 includes, as main components, a portable device 202 as an electronic device and a cable unit 302 functioning as an antenna.

The portable device 202 is a smartphone with an embedded television tuner, for example. The portable device 202 includes a display circuit, a display unit such as a liquid crystal display device, and an operation unit for performing key input and the like. The portable device 202 has a round-shaped four-pole jack 11 for earphone and microphone connection. A four-pole plug 25 connected to the four-pole jack 11 has a diameter of 3.5 mm, as an example.

The four-pole jack 11 formed in the portable device 202 has an electrode TL connected to the tip 31 (L channel terminal) of the four-pole plug 25, an electrode TR connected to the ring 32 (R channel terminal) of the four-pole plug 25, an electrode TM connected to the ring 33 (microphone terminal) of the four-pole plug 25, and an electrode TG connected to the sleeve 33 (ground terminal) of the four-pole plug 25.

A signal line of an audio L channel is drawn to the electrode TL through a ferrite bead 12. A signal line of an audio R channel is drawn to the electrode TR through a ferrite bead 13. The electrode TG is drawn as an audio ground line through a ferrite bead 14, and is drawn as an antenna signal line through a condenser 16. The antenna signal line is connected to a reception device (tuner) in the portable device 202, although it is not illustrated. Furthermore, a microphone line is drawn to the electrode TM through a ferrite bead 15. The ferrite beads 12, 13, 14, 15 are connected to cut off a high-frequency component. Coils may be used instead of the ferrite beads.

In the third embodiment, the cable unit 302 includes a shield cable 66 connected to the four-pole plug 25, the earphone cables 22L, 22R, 22G connected between the shield cable 66 and the earphones 23L, 23R, a microphone cable 22M connected between the shield cable 66 and a microphone 71, and the high impedance part 51 inserted between the shield cable 66, and the earphone cable and the microphone cable. The length of the shield cable 66 is 1200 mm, for example.

Figure 6:
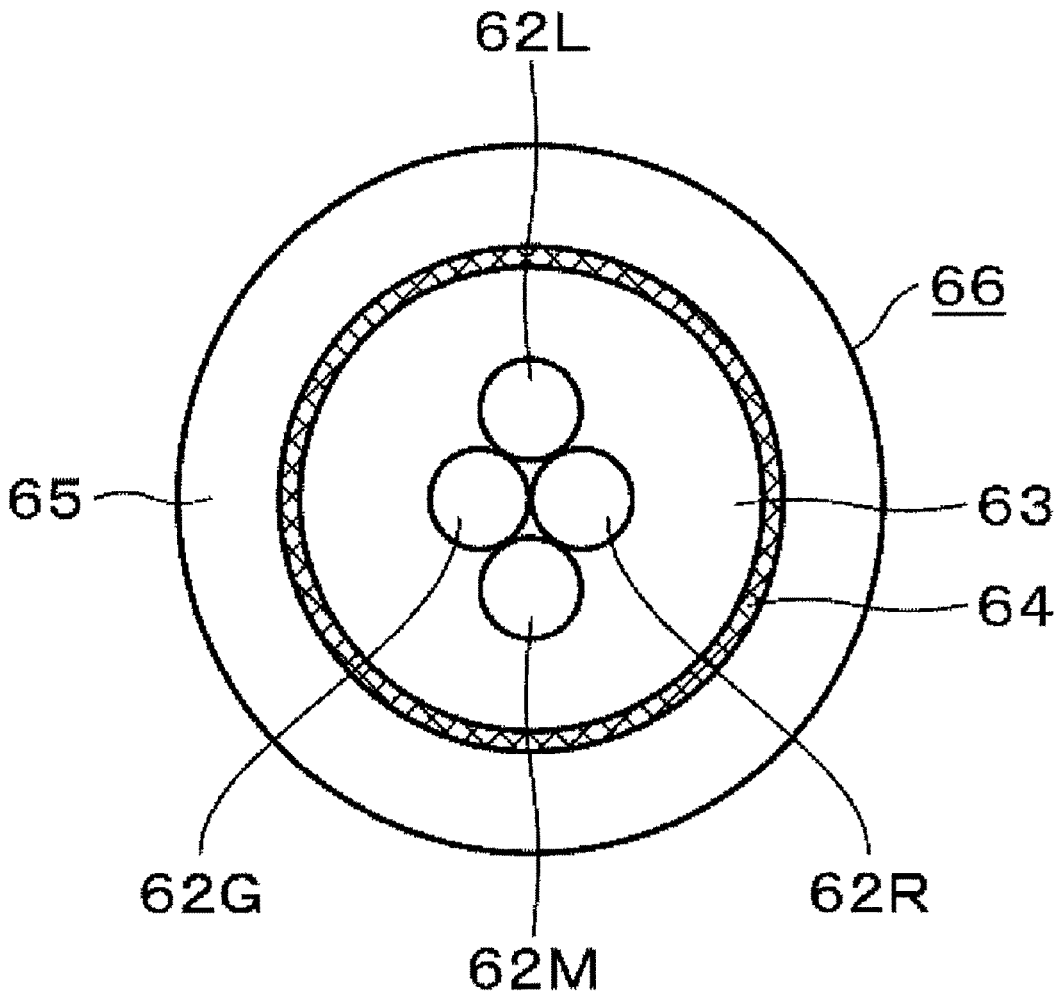
FIG. 6 is a section view used for explanation of a shield cable in the third embodiment of the present disclosure.

FIG. 6 is a section view of the shield cable 66 cut vertically in a line length direction. In the core part of the shield cable 66, there are provided, as core wire (inner conductors), the line 62L for audio signal transmission of an L channel, the line 62R for audio signal transmission of an R channel, the ground line 62G, and a microphone cable 62M. On the outer side of these transmission lines 62L, 62R, 62G, 62M (simply referred to as the line 62 when it is not necessary to particularly distinguish these four lines from one another), a layer of resin 63 is provided.

On the periphery of the resin 63, the shield line 64 as an outer conductor is provided. The shield line 64 functions as an antenna. The outer periphery of the shield line 64 is coated by the protective film 65. The resin 63 is synthetic resin in which a magnetic material, e.g., ferrite powder is mixed, for example. With the use of such resin 63, the resin 63 is interposed as an radio wave absorbing part between the shield line 64 and the line 62, which secures isolation between the shield line 64 and the line 62. Thus, the characteristics of the shield line 64 as an antenna can be more desirable.

The lines of the shield cable 66 are connected to the electrode 41, the electrode 42, the electrode 43, and an electrode 46 projecting on the back side of the four-pole plug 25 through the relay 24. The relay 24 is formed as a substrate or by molding. In the relay 24, the line 62R is connected to the electrode 42 on the back end part of the four-pole plug 25 through the ferrite bead 44 having a high-frequency cutoff function. The line 62L is connected to the electrode 41 on the back end part of the four-pole plug 25 through the ferrite bead 45 having a high-frequency cutoff function. Furthermore, the ground line 62G and the shield line 64 are connected to the electrode 43 on the back end part of the four-pole plug 25. Furthermore, the microphone line 62M is connected to the electrode 46 on the back end part of the four-pole plug 25 through a ferrite bead 47 having a high-frequency cutoff function. Coils may be connected instead of the ferrite beads 44, 45, 47. The ferrite beads 44, 45, 47 are provided for high-frequency cutoff to have low impedance in an audio band and high impedance in a high-frequency region, e.g., a VHF band or higher.

The earphone cable 22R is connected to the line 62R, the earphone cable 22L is connected to the line 62L, the earphone cable 22G is connected to the ground line 62G, and the microphone cable 22M to the line 62M. At a connection position between the shield cable 61, and the earphone cable and the microphone cable, the high impedance part 51 is provided.

The same high impedance part 51 described with reference to FIG. 2 can be used. With the high impedance part 51, the influence of the earphones 23L, 23R and the microphone 71 and the influence of the human body are cut off. In this manner, regarding the antenna of the cable unit 302, it is possible to prevent the characteristics change due to the earphones and the gain reduction by influence of the human body.

<4. Fourth Embodiment>

"Reception System"

Figure 7:
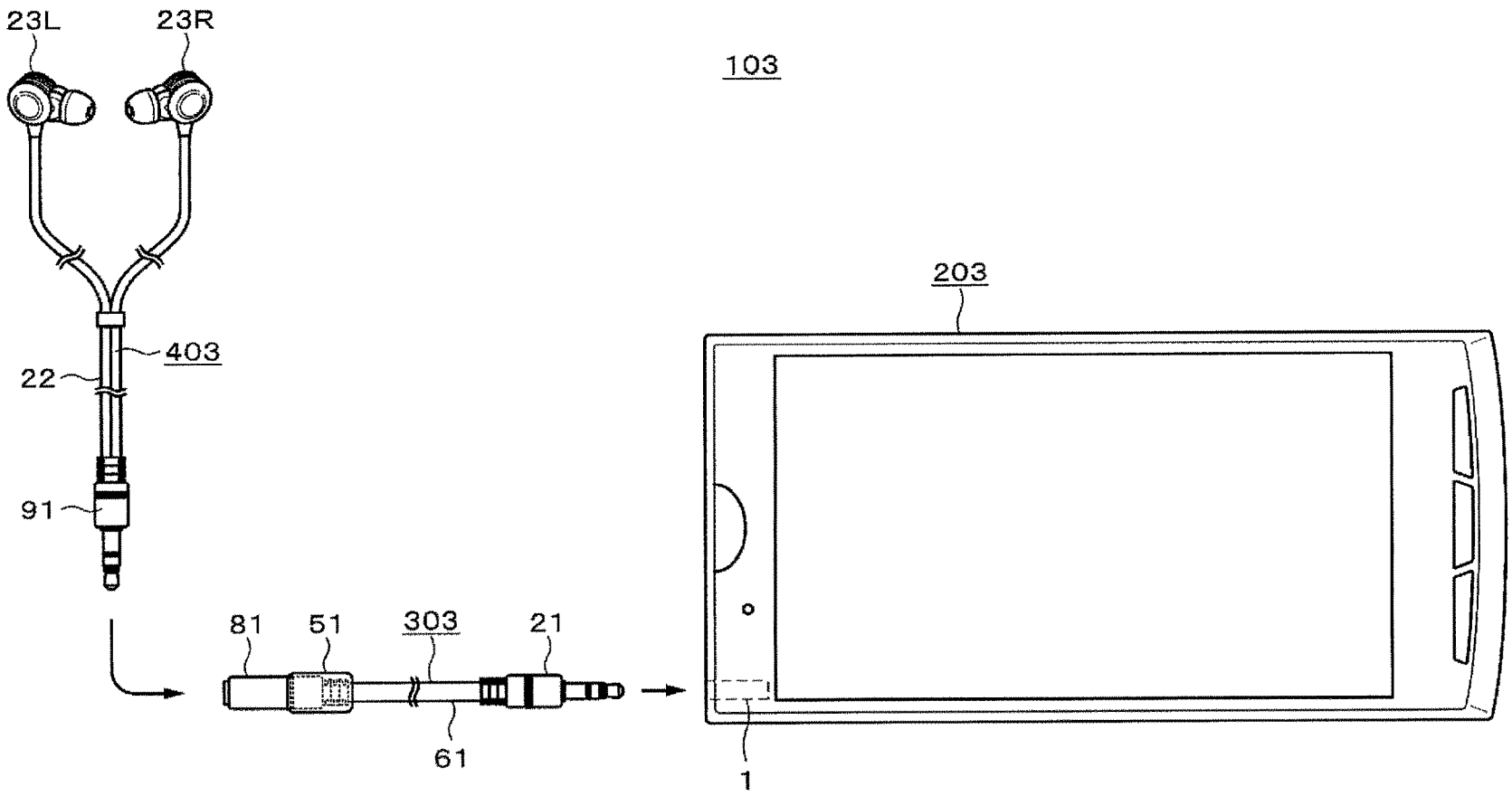
FIG. 7 is a schematic diagrammatic view illustrating an appearance of a fourth embodiment of the present disclosure.

A reception system (reception device) according to the fourth embodiment of the present disclosure will be described with reference to FIG. 7 and FIG. 8. A reception system 103 includes, as components, a portable device 203 as an electronic device, a cable unit 303 functioning as an antenna, and an earphone unit 403.

The portable device 203 has the three-pole jack 1, for example, as a connection part. Similarly to the above-described second embodiment, the antenna cable unit 303 has the three-pole plug 21 connected to the three-pole jack 21 and the shield cable 61 connected to the three-pole plug 21. A three-pole jack 81 is connected to the other end of the shield cable 61, and the high impedance part 51 is provided between the shield cable 61 and the three-pole jack 81.

The earphone unit 403 has a configuration in which the earphones 23L, 23R are connected to a three-pole plug 91 connected to the three-pole jack 81 through the earphone cable 22. The three-pole plugs 21, 91 and the three-pole jacks 1, 81 that are used in the fourth embodiment have a diameter of 3.5 mm, for example.

The shield line 64 of the shield cable 61 functions as a monopole antenna. The length of the shield cable 61 is set to about $\lambda/4$. The high impedance part 51 is provided. Thus, the antenna characteristics are hardly changed regardless of whether the three-pole plug 91 is connected to the three-pole jack 81.

Figure 8:
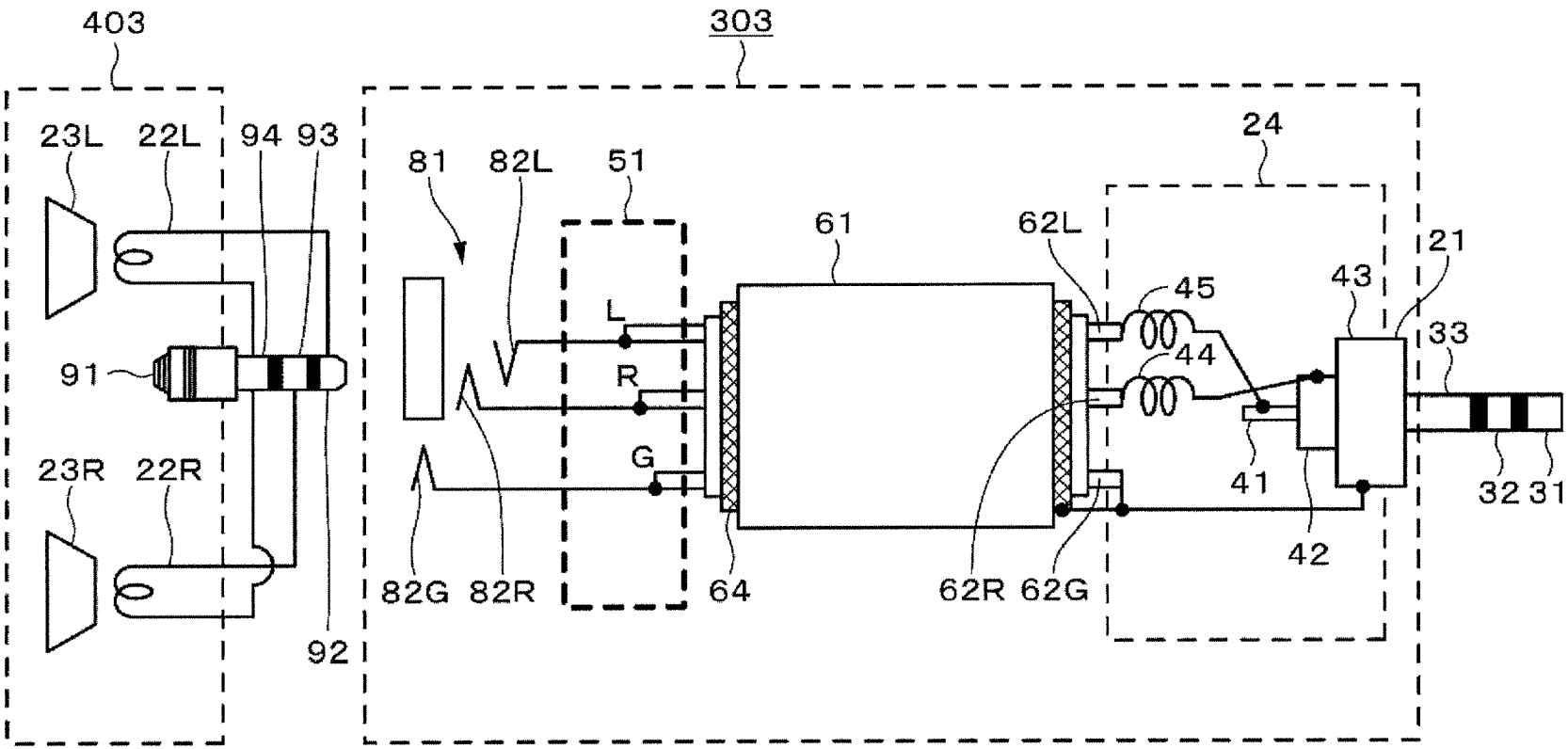
FIG. 8 is a connection diagram of the fourth embodiment of the present disclosure.

FIG. 8 illustrates an electric configuration of the fourth embodiment. The three-pole jack 81 has a terminal 82R, a terminal 82L, and a ground terminal 82G. In the vicinity of the three-pole jack 81, an insulator and the like are removed on the other end portion of the shield cable 61, so that the lines 62R, 62L, 62G are exposed. Moreover, the shield line 64 is exposed in the vicinity of the three-pole jack 81. Then, the line 62R is connected to the terminal 82R, the line 62L is connected to the terminal 82L, and the line 62G is connected to the terminal 82G.

"Earphone Unit 403"

One end portion of the earphone cable 22 is divided and connected to the earphones 23R, 23L, and the three-pole plug 91 is connected to the other end. The three-pole plug 91 can be connected by inserting its cylindrical end portion into the three-pole jack 81, and includes a tip 92, a ring 93, and a sleeve 94. On the back side of the three-pole plug 91, the earphone 23L is connected between the tip 92 and the sleeve 94, and the earphone 23R is connected between the ring 93 and the sleeve 94.

"High Impedance Part"

Figure 9:
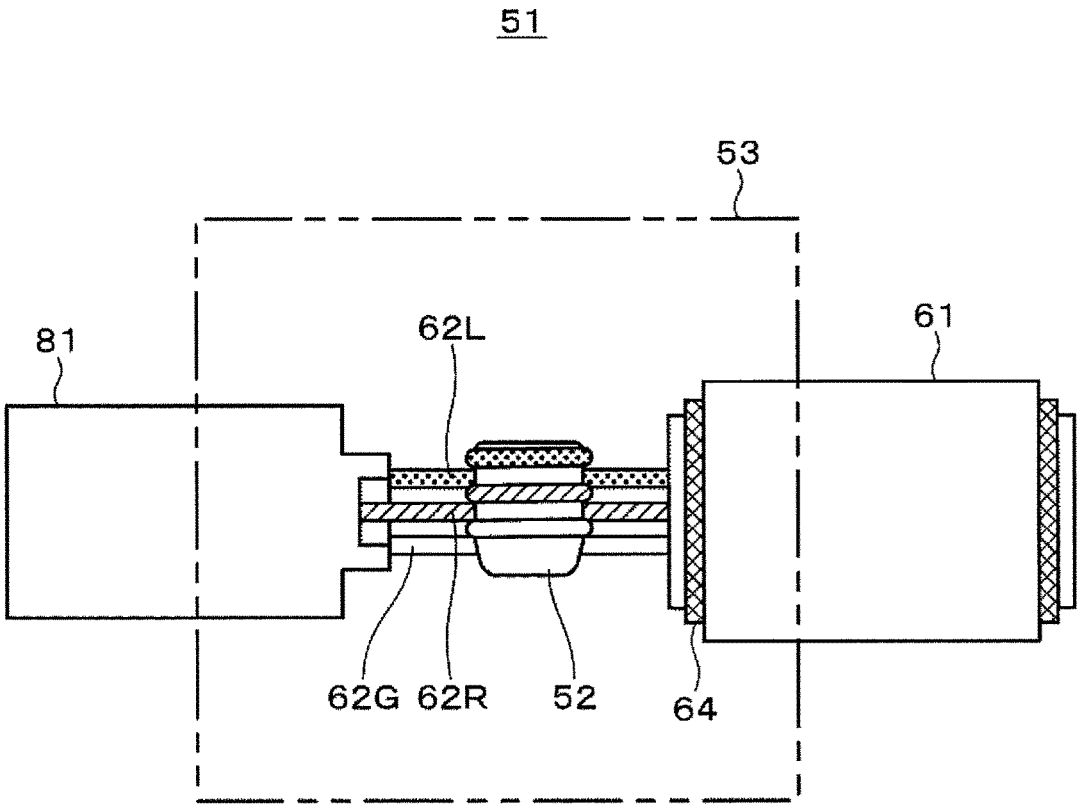
FIG. 9 is a schematic diagrammatic view used for explanation of a high-frequency cutoff unit in the fourth embodiment of the present disclosure.

The high impedance part 51 in the fourth embodiment has a configuration illustrated in FIG. 9, for example. The lines 62L, 62R, 62G led out from the shield cable 61 are wound once around the cylindrical (ring-shaped) ferrite core 52 and then connected to the three-pole jack 81. In this example, the line 62 is wound once around the ferrite core 52. Thus, the structure is of two-turn. The line 62 wound once is fixed by the resin mold (illustrated by a two dotted chain line) 53. The ferrite core divided vertically may be used, or two or more ferrite cores may be used.

The ferrite core 52 of such a high impedance part 51 has frequency characteristics of the impedance illustrated in FIG. 2D. That is, the ferrite core 52 has a higher impedance with a higher frequency. In addition, a flow of a current in the coil formed of the ferrite cores exerts the effect of losing energy due to magnetic loss occurred in the ferrite cores, thus increasing higher impedance (resistive component).

The high impedance part 51 has a low impedance value in the audio signal band. Thus, the high impedance part 51 does not have influence on transmission of audio signals. By contrast, the high impedance part 51 has large impedance for a high-frequency signal component, as described above. Therefore, the influence of the earphones 23L, 23R and the influence of the human body are cut off by the high impedance part 51. In this manner, it is possible to prevent the characteristics change due to the earphone unit 403 connected to the three-pole jack 81 and the gain reduction by influence of the human body.

"Characteristics of Fourth Embodiment"

Figure 10:
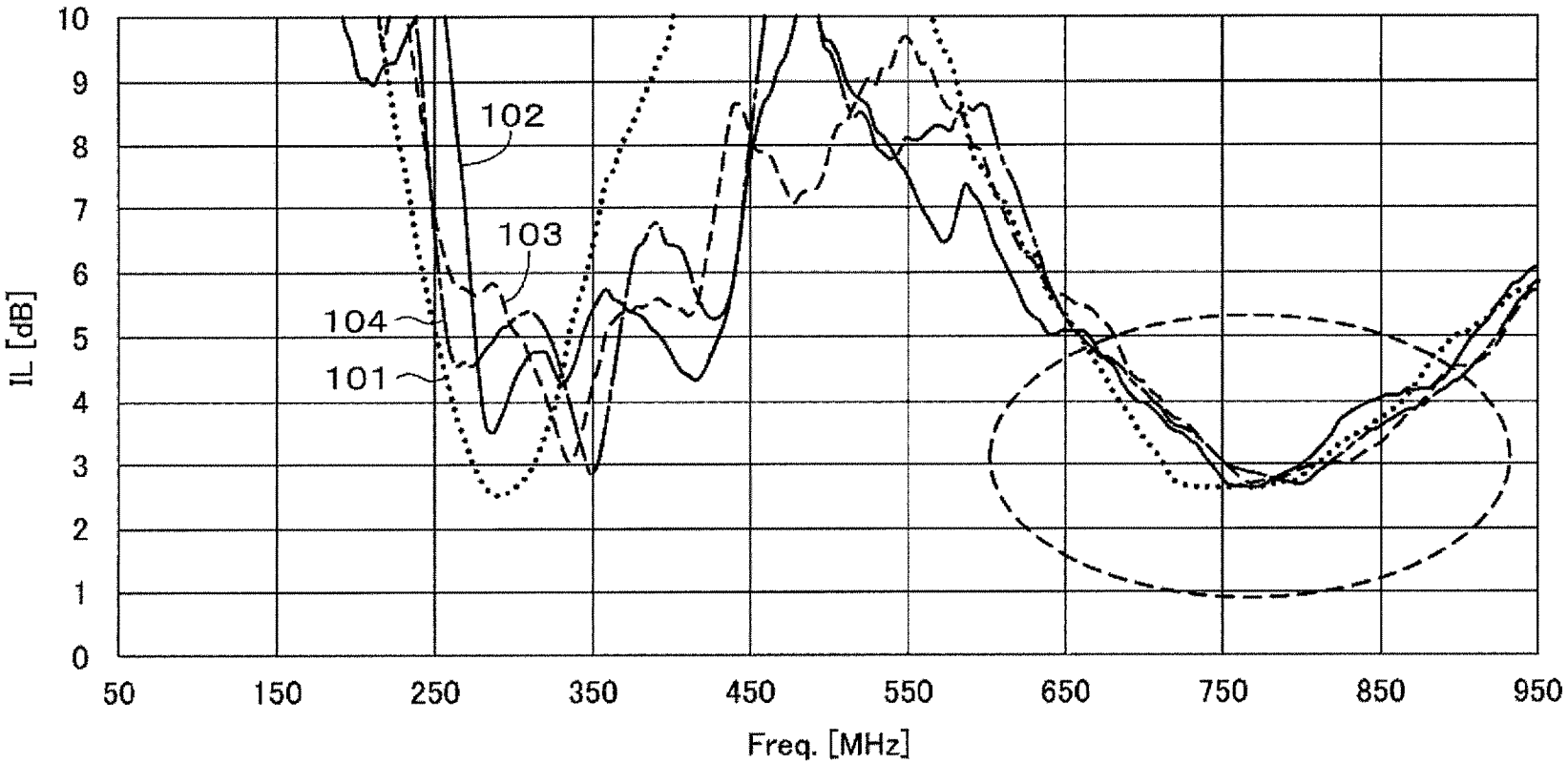
FIG. 10 is a graph used for explanation of frequency characteristics in each of the case where an earphone unit is not connected and the cases where an earphone cable of different lengths is connected, in the fourth embodiment of the present disclosure.

FIG. 10 illustrates a measurement result of a voltage standing wave ratio (VSWR) of the fourth embodiment. In FIG. 10, a horizontal axis indicates a frequency, and a vertical axis indicates a value of a reflection loss. In FIG. 10, a curve 101 indicates characteristics when the earphone unit 403 is not connected. Such characteristics are the most desirable characteristics. The reflection loss in the UHF band surrounded by a dashed line is small.

Each of the other curves 102, 103, 104 illustrates characteristics when a different kind of earphone unit 403 is connected to the three-pole jack 81. The curve 102 indicates characteristics when an earphone cable with a length of 500 mm is connected to the three-pole jack 81. The curve 103 indicates the characteristics when an earphone cable with a length of 1.5 m is connected to the three-pole jack 81. The curve 104 indicates characteristics when an earphone cable with a length of 1 m is connected to the three-pole jack 81. The same high impedance part 51 is used.

As seen from FIG. 10, the characteristics of main resonance in the UFH band are not changed significantly depending on the presence or absence of connection of the earphone unit 403, and the length of the connected earphone unit 403. That is, with the high impedance part 51, the influence by the components on the distal side relative to the three-pole jack 81 can be cut off.

Figure 11:
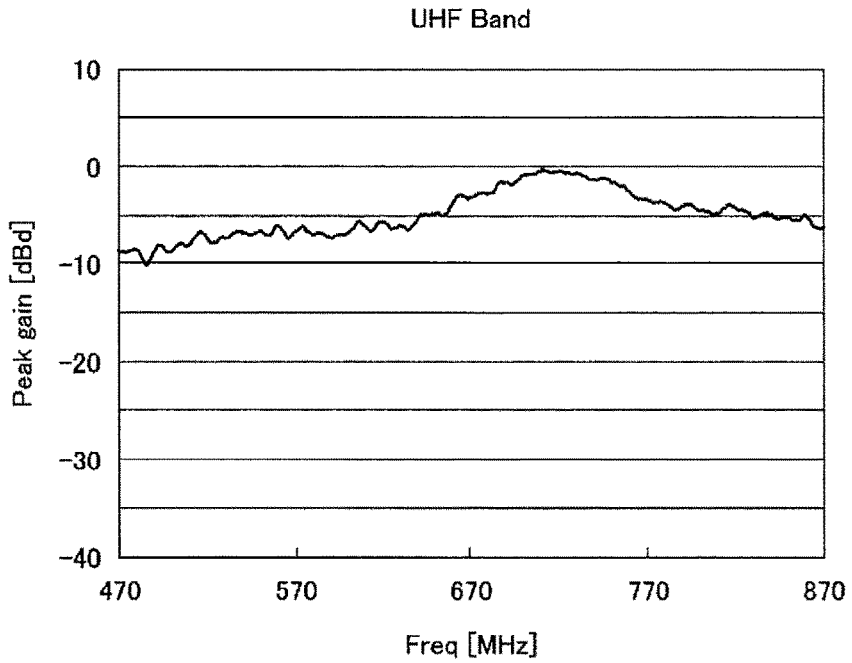
FIG. 11 is a diagram illustrating peak gain characteristics in the case where an earphone unit is not connected, in the fourth embodiment of the present disclosure.
Figure 12:
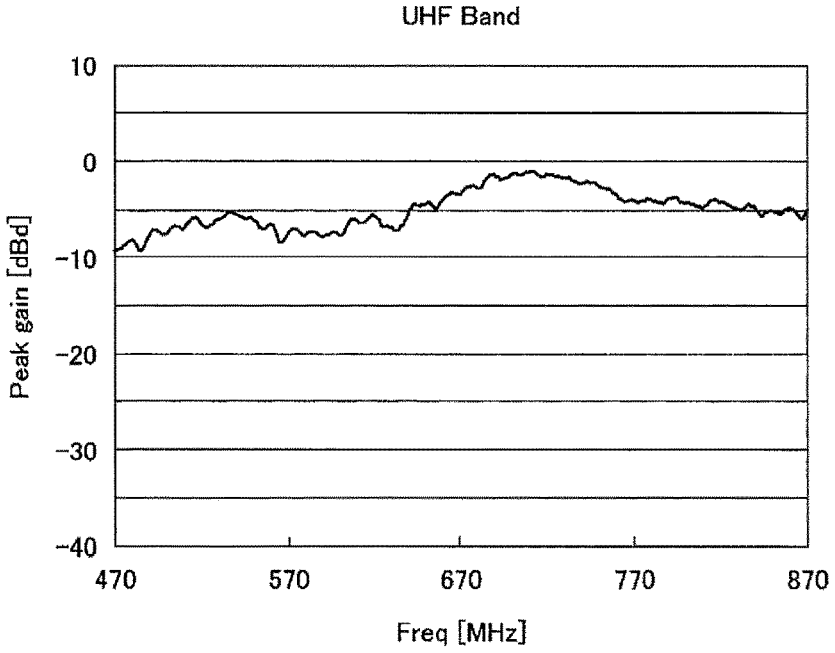
FIG. 12 is a diagram illustrating peak gain characteristics in the case where an earphone unit is connected, in the fourth embodiment of the present disclosure.
Figure 13:
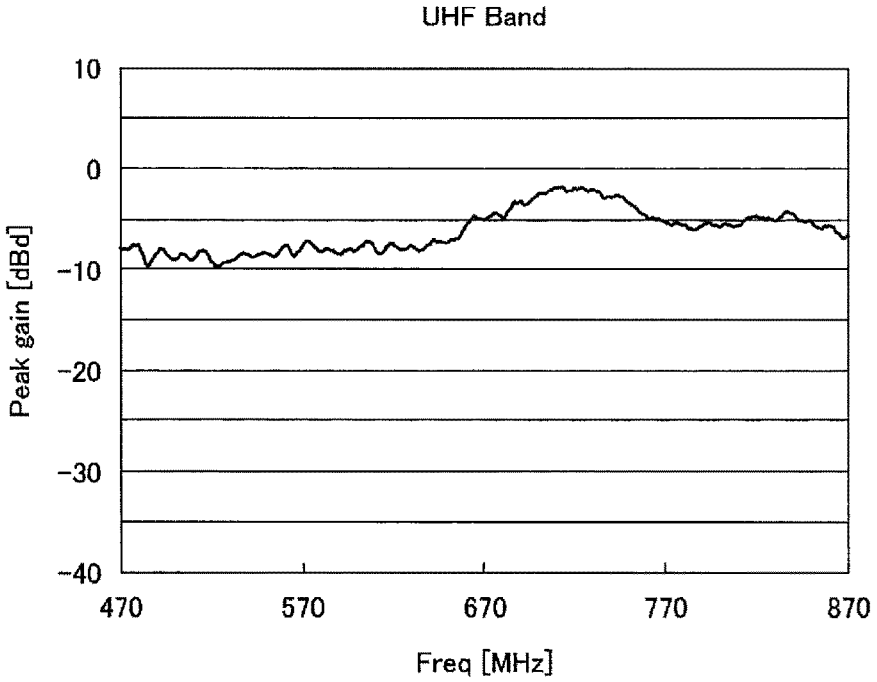
FIG. 13 is a diagram illustrating peak gain characteristics in the case where an earphone unit is connected, in the fourth embodiment of the present disclosure.

FIG. 11, FIG. 12, and FIG. 13 are diagrams illustrating peak gain characteristics relative to frequencies in the fourth embodiment. The peak gain is a relative gain to a gain of a dipole antenna. The curve illustrated in each of FIG. 11A, FIG. 12A, and FIG. 13A indicates characteristics of horizontal polarization. FIG. 11B, FIG. 12B, and FIG. 13B are tables showing measurement results in detail.

FIG. 11 illustrates characteristics with the single cable unit 303. FIG. 12 illustrates characteristics when the earphone unit 403 having an earphone cable with a length of 1200 mm is connected. FIG. 13 illustrates characteristics when the earphone unit 403 having an earphone cable with a length of 1200 mm is connected, and the earphones 23L, 23R are fitted on ears. As seen from FIG. 11, FIG. 12, and FIG. 13, it is possible to reduce the change of VSWR when the earphone unit 403 is connected. In addition, it is possible to reduce the change of VSWR when the earphones are fitted on ears and secure an antenna gain.

<5. Modification Examples>

The foregoing has described in detail the embodiments of the present disclosure, but it is not intended to be limited to each embodiment described above and various modifications may be performed based on the technical concept of the present disclosure. For example, the configurations, the methods, the processes, the shapes, the materials, the numerical values, and the like mentioned in the above embodiments are merely examples, and a configuration, a method, a process, a shape, a material, a numerical value, and the like different therefrom may be used if necessary. For example, the connection device between the electronic device and the cable unit is not limited to a plug, but another connector such as μ universal serial bus (USB) may be used.

Additionally, the present disclosure may also be configured as below.

(1)

An antenna including:

a connection device for connection with an electronic device;

a cable connected to the connection device; and a high-frequency cutoff unit that is formed of a material having high impedance in a high frequency and disposed at a given position of the cable, wherein the cable with a length defined by the high-frequency cutoff unit functions as an antenna.

(2)

The antenna according to (1), wherein the length defined by the high-frequency cutoff unit is a length of nearly ¼ of a wavelength to be received.

(3)

The antenna according to (2), wherein a signal at a higher frequency than a frequency of a signal to be received can also be received by high-frequency excitation.

(4)

The antenna according to (1) or (2), wherein the material having high impedance in a high frequency is a magnetic material such as ferrite.

(5)

The antenna according to any of (1) to (3), wherein a cylindrical or ring-shaped core is formed of the material having high impedance in a high frequency, and the cable penetrates through a center hole of the core or is wound a given number of times to form the high-frequency cutoff unit.

(6)

The antenna according to any of (1) to (4), wherein the cable is a cable with a shield including a shield line and a signal transmission line in the shield line, the shield line functioning as an antenna, and the high-frequency cutoff unit is disposed for the signal line at an opposite end to the connection device.

(7)

The antenna according to (6), wherein another connection device is provided at the opposite end of the cable to the connection device, and the high-frequency cutoff unit is provided for the signal line at a connection position between the cable and the other connection device.

(8)

The antenna according to (7), wherein a length of the shield line is a length of nearly ¼ of a wavelength to be received.

(9)

The antenna according to (8), wherein a signal at a higher frequency than a frequency of a signal to be received can also be received by high-frequency excitation.

(10)

The antenna according to (6), wherein the signal transmission line is an audio signal transmission line, and an earphone is connected to the signal transmission line.

REFERENCE SIGNS LIST

1, 81 three-pole jack
11 four-pole jack
21, 91 three-pole plug
22R, 22L, 22G earphone cable
22M microphone cable
23L, 23R earphone
25 four-pole plug
51 high impedance part
61, 66 shield cable
100, 101, 102, 103 reception system
200, 202, 203 portable device

300, 301, 302, 303 cable unit
403 earphone unit

The invention claimed is:

1. An antenna comprising:

a connection device for connection with an electronic device;

a cable connected to the connection device; and a high-frequency cutoff unit that is formed of a material having high impedance at a high frequency and is spaced from the connection device along the cable, wherein the cable with a length defined by the high-frequency cutoff unit functions as an antenna.

2. The antenna according to claim 1, wherein the length defined by the high-frequency cutoff unit is a length of nearly ¼ of a wavelength to be received.

3. The antenna according to claim 2, wherein a signal at a higher frequency than a frequency of a signal to be received can also be received by high-frequency excitation.

4. The antenna according to claim 1, wherein the material having high impedance in a high frequency is a magnetic material such as ferrite.

5. The antenna according to claim 1, wherein a cylindrical or ring-shaped core is formed of the material having high impedance in a high frequency, and the cable penetrates through a center hole of the core or is wound a given number of times to form the high-frequency cutoff unit.

6. The antenna according to claim 1, wherein the cable is a cable with a shield including a shield line and a signal transmission line in the shield line, the shield line functioning as an antenna, and the high-frequency cutoff unit is disposed for the signal line at an opposite end to the connection device.

7. The antenna according to claim 6, wherein another connection device is provided at the opposite end of the cable to the connection device, and the high-frequency cutoff unit is provided for the signal line at a connection position between the cable and the other connection device.

8. The antenna according to claim 7, wherein a length of the shield line is a length of nearly ¼ of a wavelength to be received.

9. The antenna according to claim 8, wherein a signal at a higher frequency than a frequency of a signal to be received can also be received by high-frequency excitation.

10. The antenna according to claim 6, wherein the signal transmission line is an audio signal transmission line, and an earphone is connected to the signal transmission line.

* * * * *